US005516614A

United States Patent [19]

Nash et al.

[11] Patent Number: 5,516,614

[45] Date of Patent: May 14, 1996

[54] INSULATIVE MAGNETIC BRUSH DEVELOPER COMPOSITIONS

[75] Inventors: Robert J. Nash, Webster; Cheryl A. Hanzlik, Fairport; Richard N. Muller, Penfield; Richard J. Hodgson, Rochester, all of N.Y.

[73] Assignee: Xerox Corporation, Stamford, Conn.

[21] Appl. No.: 379,224

[22] Filed: Jan. 27, 1995

[51] Int. Cl.[6] ..... G03G 9/083

[52] U.S. Cl. ..... 430/106.6; 430/108

[58] Field of Search ..... 430/106.6, 108, 430/110

[56] References Cited

U.S. PATENT DOCUMENTS

| | | | |
|---|---|---|---|
| 3,635,704 | 1/1972 | Palermiti et al. | 96/1 |
| 3,900,587 | 8/1975 | Lenhard et al. | 427/19 |
| 3,983,045 | 9/1976 | Jugle et al. | 252/62.1 P |
| 4,557,991 | 12/1985 | Takagiwa et al. | 430/109 |
| 4,997,739 | 3/1991 | Tomono et al. | 430/110 |
| 5,227,460 | 7/1993 | Mahabadi et al. | 528/272 |
| 5,230,980 | 7/1993 | Maniar | 430/108 |
| 5,260,159 | 11/1993 | Ohtani et al. . | |
| 5,368,970 | 11/1994 | Grushkin | 430/110 |

*Primary Examiner*—John Goodrow
*Attorney, Agent, or Firm*—E. O. Palazzo

[57] ABSTRACT

An insulating developer composition comprised of resin particles, pigment particles, wax component particles, compatibilizer, and a surface additive mixture comprised of metal salts of fatty acids, silica particles, and metal oxide particles; and carrier particles comprised of a ferrite core with a polymer coating or mixture of polymer coatings; and wherein said developer is of a conductivity of from about $10^{-14}$ to about $10^{-16}$(ohm-cm)$^{-1}$.

36 Claims, No Drawings

INSULATIVE MAGNETIC BRUSH DEVELOPER COMPOSITIONS

BACKGROUND OF THE INVENTION

This invention is generally directed to toner and developer compositions, and more specifically, the present invention is directed to insulative magnetic brush toner and developer compositions. In embodiments, the present invention is directed to negatively charged toner compositions comprised of polyester resins, especially certain crosslinked extruded polyesters, wax, optional compatibilizer, pigment, and surface additives of, for example, metal salts of fatty acids, silica particles, metal oxides like titanium dioxide, fluoropolymer particles, such as KYNAR®, and the like, and wherein the developer is comprised of toner and a carrier coated with a polymer, such as polymethylmethylacrylate or mixture of polymers and carbon black.

The developers of the present invention can be preferably selected for insulative magnetic brush imaging systems, and those imaging methods as illustrated in U.S. Pat. Nos. 4,397,264 and 4,948,686, the disclosures of which are totally incorporated herein by reference. Insulative development is particularly appropriate for copying fine-line and/or light density images, such as kanji characters handwritten with a pencil. Insulative development can also generate developed images with an extended tonal range, that is a range of image densities from light gray to black, and this allows, for example, continuous tone images to be copied from input images such as photographs. The extended tonal range characteristic of insulative development is also of utility in digital copiers or printers based on imaging by intensity-modulated lasers.

With the developers of the present invention, low melting polyesters can be selected as the toner resin permitting, for example, lower fuser energies; and the toner size is, for example, from about 7 to about 15 and preferably 9 microns in average volume diameter as determined by a Coulter Counter and narrow GSD in embodiments, for example about 1.3. Additionally, the developers of the present invention in embodiments enable high levels of toner flow, for example from about 7 to about 10 grams per minute, and a developer tribo of from about −10 to about −25 microcoulombs per gram. Moreover, in embodiments the surface additive of a fatty acid salt like zinc stearate or a fluoropolymer, such as KYNAR®, function primarily as a photoreceptor cleaning component and the fumed silica functions primarily as a flow aid, toner blocking avoidance component, and for assistance in achieving excellent admix characteristics. The third additive in the surface mixture assists in achieving a combination of excellent toner flow, admix, and blocking characteristics, and moreover the three surface mixture assists in controlling the tribocharge of the toner, especially with 0.6 weight percent of titanium dioxide P25® available from Degussa Chemicals, and 0.6 weight percent of the fumed silica TS530® available from Cabot Corporation, and zinc stearate present in an amount of 0.3 weight percent.

Toner and developers with toner additives like wax and surface additives of, for example, metal oxides, and colloidal slicas are known. Toners with polyesters, including extruded polyesters are also known, reference U.S. Pat. No. 5,227,460, the disclosure of which is totally incorporated herein by reference. In U.S. Pat. No. 4,795,689, there is disclosed an electrostatic image developing toner comprising as essential constituents a nonlinear polymer, a low melting polymer, which is incompatible with the nonlinear polymer, a copolymer composed of a segment polymer, which is at least compatible with the nonlinear polymer, and a segment polymer, which is at least compatible with the low melting polymer, and a coloring agent, see the Abstract, and columns 3 to 10 for example; and U.S. Pat. No. 4,557,991 discloses a toner for the development of electrostatic images comprised of a certain binder resin, and a wax comprising a polyolefin, see the Abstract; also see columns 5 and 6 of this patent and note the disclosure that the modified component shows an affinity to the binder and is high in compatibility with the binder, column 6, line 25.

Developer and toner compositions with certain waxes therein, which waxes can be selected as a component for the toners of the present invention, are known. For example, there are illustrated in U.K. Patent Publication 1,442,835, the disclosure of which is totally incorporated herein by reference, toner compositions containing resin particles, and polyalkylene compounds, such as polyethylene and polypropylene of a molecular weight of from about 1,500 to about 20,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, in U.S. Pat. No. 4,997,739, there is illustrated a toner formulation including polypropylene wax ($M_w$: from about 200 to about 6,000) to improve hot offset. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates, such as papers, wherein there is selected toner compositions containing specific external lubricants including various waxes, see column 5, lines 32 to 45.

However, there are various problems observed with the inclusion of polyolefin or other waxes in toners. For example, when a polypropylene wax is included in toner to enhance the release of toner from a hot fuser roll, or to improve the lubrication of fixed toner image it has been observed that the wax does not disperse well in the toner resin. As a result, free wax particles are released during the pulverizing step in, for example, a fluid energy mill and the pulverization rate is lower. The poor dispersion of wax in the toner resin and, therefore, the loss of wax will then impair the release function it is designed for. Scratch marks, for example, on xerographic developed toner solid areas caused by stripper fingers were observed as a result of the poor release. Furthermore, the free wax remaining in the developer will build up on the detone roll present in the xerographic apparatus causing a hardware failure.

All the problems mentioned above, and others can be eliminated, or minimized with the toner compositions and processes of the present invention in embodiments thereof. The release of wax particles is, for example, a result of, for example, poor wax dispersion during the toner mechanical blending step. The wax additives should be dispersed well in the primary toner resin for them to impart their specific functions to the toner and thus the developer. For some of the additives, such as waxes like polypropylene, VISCOL 550™, that become a separate molten phase during melt mixing, the difference in viscosity between the wax and the resin can be orders of magnitude apart, thus causing difficulty in reducing the wax phase domain size. A more fundamental reason for poor dispersion is due to the inherent thermodynamic incompatibility between polymers. The Flory-Huggins interaction parameter between the resin and the wax is usually positive (repulsive) and large so that the interfacial energy remains very large in favor of phase separation into large domains to reduce interfacial area. Some degree of success has been obtained by mechanical blending of the toner formulation in certain types of mixers, such as the known Banbury mixer, where the temperature of melt can be maintained at a low level and polymer viscosities are not that far apart. However, it has been found difficult to generate an effective wax dispersion in compounding extruders where melt temperatures are typically higher. The inclusion of an optional compatibilizer of the present invention is designed to overcome the inherent incompatibility between different polymers, and, more specifically, between toner resin and wax, thus widening the processing temperature latitude and enabling the toner preparation in a large variety of equipment, for example an extruder. The improvement in thermodynamic compatibility will also provide for a more stable dispersion of secondary polymer phase, such as wax, in the host resin against gross phase separation over time.

Illustrated in copending patent applications U.S. Ser. No. 379,822, filed concurrently herewith, is a developer composition comprised of negatively charged toner particles comprised of crosslinked polyester resin particles, pigment particles, and a surface additive mixture comprised of metal salts of fatty acids in an amount of from about 0.2 to about 0.5 weight percent, and silica particles in an amount of from about 0.2 to about 0.5 weight percent; and carrier particles comprised of a core with a coating thereover containing a conductive component; U.S. Ser. No. 379,821, filed concurrently herewith, illustrates a developer composition comprised of a negatively charged toner composition comprised of crosslinked polyester resin particles, pigment particles, wax component particles, a compatibilizer and a surface additive mixture comprised of metal salts of fatty acids, silica particles and metal oxide particles; and carrier particles comprised of a core with a polymer coating or mixture of polymer coatings; and wherein said coating or coatings contain a conductive component; and U.S. Ser. No. 379,838, filed concurrently herewith, illustrates a developer composition comprised of negatively charged toner particles comprised of crosslinked polyester resin particles, pigment particles, and a surface additive mixture comprised of metal salts of fatty acids in an amount of from about 0.2 to about 0.5 weight percent, metal oxide particles in an amount of from about 0.3 to about 1 weight percent, and silica particles in an amount of from about 0.2 to about 0.5 weight percent; and carrier particles comprised of a core with a coating thereover containing a conductive component.

SUMMARY OF THE INVENTION

Examples of objects of the present invention include the following:

It is an object of the present invention to provide toner and developer compositions which possess many of the advantages illustrated herein.

Another object of the present invention resides in the provision of insulative toner and developer compositions with stable negatively charged triboelectrical characteristics for extended time periods.

In another object of the present invention there are provided toner and developer compositions that enable improved dispersion of resin and wax components achievable in a number of devices, including an extruder.

Additionally, another object of the present invention relates to the provision of toner and developer compositions with a wax, an optional compatibilizer, and certain polyester resins.

In a further object of the present invention the toner mechanical blending operation can be accomplished at a melt temperature as high as 50° C. above the melting point of the wax component, thus enabling the use of a large number of apparatuses in addition to a low melt temperature mixing process using equipment such as a Banbury mixer.

Additionally, in yet another object of the present invention there are provided negatively charged toner and developer compositions with certain waxes therein or thereon that enable images of excellent quality inclusive of acceptable resolutions, and that possess other advantages as illustrated herein such as low surface energy.

Additionally, another object of the present invention relates to the provision of insulating developer compositions, for example with a conductivity of from about $10^{-12}$ to about $10^{-16}$ and preferably $10^{-13}$ to $10^{-14}$ (ohm-cm)$^{-1}$, and a breakdown potential of at least about 300 volts and, for example, from about 300 to about 1,000, as determined in a conductivity cell, reference U.S. Pat. No. 5,196,803, the disclosure of which is totally incorporated herein by reference, and wherein in embodiments the developer tribo is from about −10 to about −25 and preferably from about −12 to about −20 microcoulombs per gram, and there is enabled a high level of developer flow, for example 7 to 25 grams per minute in a flow tube tester.

Further, another object of the present invention relates to the provision of insulative developer compositions wherein the toner selected contains resin, wax, pigment, and a mixture of surface additives comprised of colloidal silica, metal salts of fatty acids, and metal oxides, and the carrier particles are comprised of a core with a polymer coating, a mixture of polymer coatings, or a polymer coating containing carbon black particles.

These and other objects of the present invention can be accomplished in embodiments by providing toner and developer compositions. More specifically, the present invention is directed to negatively charged toner compositions comprised of crosslinked polyester resin particles, pigment particles, waxes, and surface additives, and a developer thereof with carrier particles comprised of a core with a coating or mixture of coatings thereover.

In embodiments of the present invention there are provided negatively charged toner compositions with a tribocharge, for example, of from about −10 to about −30 microcoulombs per gram, comprised of extruded low melting polyester resin particles, optional second crosslinked resin particles, carbon black pigment particles, low molecular weight waxes, such as polyethylene and polypropylene like those available from Sanyo Chemicals of Japan as VISCOL 550P™ and VISCOL 660P™ and the like, and as a compatibilizer the reaction product of the hydroxyl end groups or acid end groups contained on toner resin particles, especially polyesters, with an ethylene-glycidyl methacrylate copolymer. The preferred compatibilizer is as illustrated in U.S. Pat. No. 5,368,970, the disclosure of which is totally incorporated herein by reference, which compatibilizer is the reaction product of an ethylene-glycidyl methacrylate copolymer with acid, or hydroxyl end groups, or mixtures thereof contained on the toner resin, which enables the grafted ethylene-glycidyl methacrylate copolymer to function as a compatibilizer and thus facilitate the dispersion of the wax as illustrated by the following

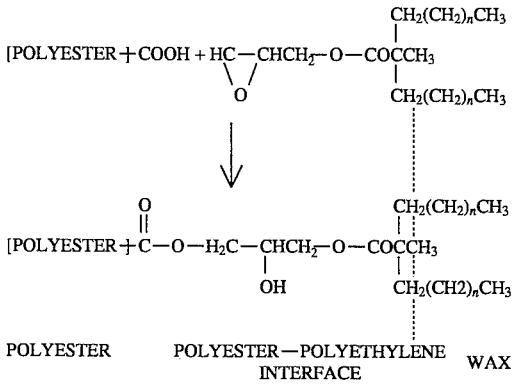

In embodiments of the present invention, there are provided negatively charged toner compositions comprised of extruded polyester resin particles, preferably with a gel content of from about 25 to about 34 and preferably about 29 percent, pigment particles, especially carbon black, and surface additives comprised of a mixture of metal salts of fatty acids, like zinc stearate, metal oxides, and silica particles, and wherein the aforementioned fatty acid salt is present in an amount of from about 0.1 to about 1 and preferably from about 0.3 to about 0.4 weight percent, and the silica and the metal oxide surface additives are present in an amount of from about 0.3 to about 1 and preferably about 0.6 weight percent, and wherein the developer is comprised of the aforementioned toners and carrier particles comprised of a core, preferably ferrite, coated with a polymer or mixture of polymers or a mixture of polymer and carbon black as indicated herein.

Also, in embodiments of the present invention there are provided negatively charged toner compositions comprised of extruded polyester resin particles, preferably with a gel content of from about 25 to about 34 and preferably about 29 percent, pigment particles, especially carbon black, wax particles with a low molecular weight of from about 1,000 to about 20,000, and surface additives comprised of a mixture of metal salts of fatty acids like zinc stearate, metal oxides, like titanium oxide, and fumed silica particles, and wherein each of the aforementioned surface additives are present in an amount of from about 0.1 to about 1 and preferably from about 0.3 to about 0.6 weight percent, and wherein the developer is comprised of the aforementioned toners and carrier particles comprised of a core, preferably ferrites coated with a polymer, or mixtures of polymers, or mixtures of polymer and carbon black. Preferably, in embodiments the extruded crosslinked polyester is present in an amount of 95 weight percent, the pigment carbon black is present in an amount of 5 weight percent, the zinc stearate is present in an amount of 0.4 weight percent, the fumed silica TS530® is present in an amount of 0.6 weight percent, and the titanium oxide or dioxide is present in an amount of 0.6 weight percent; the carrier is comprised of ferrite core, about 100 microns, with a polymer coating, such as methylterpolymer and the like. The toner concentration can vary and preferably is from about 2 to about 6 weight percent. Also, the carrier may contain a mixture of polymer coatings, such as PMMA and FPC461 available from Occidental Chemicals, and wherein each of the polymers is present in an a mount of form about 1 to about 99 and preferably from about 40 to about 60 weight percent.

Illustrative examples of suitable toner resins include styrene acrylates, styrene methacrylates, styrene butadienes, and polyesters, especially the crosslinked polyesters of U.S. Pat. No. 5,227,460, the disclosure of which is totally incorporated herein by reference. These polyester resins can be prepared by a reactive resin, such as for example wherein an unsaturated linear polyester resin is crosslinked in the molten state under high temperature and high shear conditions, preferably using a chemical initiator such as, for example, organic peroxide, as a crosslinking agent in a batch or continuous melt mixing device without forming any significant amounts of residual materials. Thus, the removal of byproducts or residual unreacted materials is not needed with embodiments of the process of the invention. In preferred embodiments of this process, the base resin and initiator are preblended and fed upstream to a melt mixing device, such as an extruder at an upstream location, or the base resin and initiator are fed separately to the melt mixing device, e.g., an extruder at either upstream or downstream locations. An extruder screw configuration, length and temperature may be used which enable the initiator to be well dispersed in the polymer melt before the onset of crosslinking, and further, which provide a sufficient, but short, residence time for the crosslinking reaction to be carried out. Adequate temperature control enables the crosslinking reaction to be carried out in a controlled and reproducible fashion. Extruder screw configuration and length can also provide high shear conditions to distribute microgels, formed during the crosslinking reaction, well in the polymer melt, and to keep the microgels from inordinately increasing in size with increasing degree of crosslinking. An optional devolatilization zone may be used to remove any volatiles, if needed. The polymer melt may then be pumped through a die to a pelletizer. One suitable type of extruder is the fully intermeshing corotating twin screw extruder, such as, for example, the ZSK-30 twin screw extruder, available from Werner & Pfleiderer Corporation, Ramsey, N.J., U.S.A., which has a screw diameter of 30.7 millimeters and a length-to-diameter (L/D) ratio of 37.2. The extruder can melt the base resin, mix the initiator into the base resin melt, provide high temperature and adequate residence time for the crosslinking reaction to be accomplished, control the reaction temperature via appropriate temperature control along the extruder channel, optionally devolatilize the melt to remove any effluent volatiles, if needed, and pump the crosslinked polymer melt through a die such as, for example, a strand die to a pelletizer. For chemical reactions in highly viscous materials, reactive extrusion is particularly efficient, and is advantageous because it requires no solvents, and thus is easily environmentally controlled. It is also advantageous because it permits a high degree of initial mixing of base resin and initiator to take place, and provides an environment wherein a controlled high temperature (adjustable along the length of the extruder) is available so that a very quick reaction can occur. It also enables a reaction to take place continuously, and thus the reaction is not limited by the disadvantages of a batch process, wherein the reaction must be repeatedly stopped so that the reaction products may be removed and the apparatus cleaned and prepared for another similar reaction. As soon as the desired amount of crosslinking is achieved, the reaction products can be quickly removed from the reaction chamber.

The crosslinked resin produced comprises crosslinked gel particles and a noncrosslinked or linear portion, but substantially no sol. The gel content of the crosslinked resin ranges from about 0.001 to about 50 percent by weight, and preferably from about 0.1 to about 40, or 10 to 19 percent by weight, wherein the gel content is defined as follows:

$$\text{Gel Content} = \frac{\text{Total Sample Weight} - \text{Weight of Soluble Polymer}}{\text{Total Sample Weight}} \times 100\%$$

There is substantially no crosslinked polymer which is not gel, that is low crosslink density polymer or sol as would be obtained in conventional crosslinking processes, such as, for example, polycondensation, bulk, solution, suspension, emulsion and suspension polymerization processes.

The crosslinked portions of the crosslinked polyester resin are comprised of very high molecular weight microgel particles with high density crosslinking (as measured by gel content), and which are not soluble in substantially any solvents such as, for example, tetrahydrofuran, toluene and the like. The microgel particles are highly crosslinked polymers with a short crosslink distance of zero or a maximum of one atom such as, for example, oxygen.

The linear portions of the crosslinked resin have substantially the same number average molecular weight ($M_n$), weight-average molecular weight ($M_w$), molecular weight distribution ($Mw/M_n$), onset glass transition temperature ($T_g$) and melt viscosity as the base resin. Thus, embodiments of the entire crosslinked resin have an onset glass transition temperature of from about 50° C. to about 70° C., and preferably from about 51° C. to about 60° C., and a melt viscosity of from about 5,000 to about 200,000 poise, and preferably from about 20,000 to about 100,000 poise at 100° C., and from about 10 to about 20,000 poise at 160° C.

Numerous well known suitable pigments can be selected as the colorant for the toner particles including, for example, carbon black like REGAL 330®, BLACK PEARLS®, and the like available from Cabot Corporation. The pigment, which is preferably carbon black, should be present in a sufficient amount to render the toner composition colored thereby permitting the formation of a clearly visible image. Generally, the pigment particles are present in amounts of from about 2 percent by weight to about 20 percent by weight, and preferably from about 5 to about 10 weight percent, based on the total weight of the toner composition, however, lesser or greater amounts of pigment particles may be selected in embodiments.

Examples of low molecular weight, for example from about 1,000 to about 20,000, and preferably from about 1,000 to about 7,000, waxes include those as illustrated in the British 1,442,835 patent publication, the disclosure of which is totally incorporated herein by reference, such as polyethylene, polypropylene, and the like, especially VISCOL 550P™ and VISCOL 660P™. The aforementioned waxes, which can be obtained in many instances from Sanyo Chemicals of Japan, are present in the toner in various effective amounts, such as for example from about 0.5 to about 10, and preferably from about 3 to about 7 weight percent. Examples of functions of the ,wax are to enhance the release of paper after fusing, and providing the fused toner image with lubrication. The release or separation of wax from the toner can reduce these functions. Also, toners with poor wax dispersion have a lower pulverizing rate and the free wax, which can remain with the toner, will build up on the internal parts of the xerographic cleaning device causing a machine failure.

The compatibilizer is, for example, as illustrated herein, and more specifically, in embodiments includes copolymers that can be reacted with the toner resin like polyesters, such as copolymers of ethylene-glycidyl methacrylate ester, LOTADER AX8840™, available from ELF ATOCHEM, NA, Inc, containing 8 weight percent of glycidyl ester, which is particularly effective as a wax dispersant when melt mixed with a polyester comprised of the reaction products of propoxylated bisphenol A and fumaric acid, which had been crosslinked with benzoyl peroxide thereby forming thirty weight percent of gel. The reaction product of polyester and 0.5 to 5.0 weight percent and preferably 1.0 to 3.0 weight percent of LOTADER AX8840™ can be accomplished in a Werner Pfleiderer extruder in the presence of aforementioned waxes, pigment, and optional charge enhancing additive. Extrusion set temperatures were adjusted so that the exiting extrudate had a temperature of from 115° C. to 160° C. When VISCOL 660P™ was used, the preferred temperature was from about 138° C. to about 150° C. When crystalline polyethylene, such as POLYWAX 1000™ available from Petrolite Corporation, was used, the extruder set temperatures were adjusted to provide an extrudate exiting the extruder with a temperature of 100° C. to 120° C. In another embodiment of the present invention, LOTADER AX8840™ and the reaction product of propoxylated bisphenol A and fumaric acid were extruded in the presence of 0.3 to 1.5 weight percent of benzoyl peroxide at a temperature of 140° to 180° C. The extrudate was then re-extruded with wax, pigment, after which it was converted to toner by attrition. Alternatively, LOTADE R AX8840™ and wax were melt mixed as a master batch with ratios of 1:1 to 10:1, then re-extruded with polyester, pigment, and additional wax. In this embodiment, constituent ratios can be adjusted in a manner that the LOTADER AX8840™ is present in an amount of from 0.2 to 10 percent, and preferably of from 1 to 4 weight percent, and the wax is present in an amount of from 2 to 10 weight percent, and preferably of from 3 to 7 weight percent. After melt mixing by extrusion, micronization and classification to a volume average size of 7 to 10 micrometers, the toner of the present invention was examined by optical microscopy at 400x magnification with crossed polarizers and found to contain no free wax as would have been evident by the appearance of birefringent particles.

For the formulation of developer compositions, there are mixed with the toner particles carrier components, particularly those that are capable of triboelectrically assuming an opposite polarity to that of the toner composition. Accordingly, the carrier particles of the present invention can be selected to be of a positive polarity enabling the toner particles, which are negatively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings, such as a terpolymer of styrene, polymethylmethacrylate and triethoxysilane (85/15/5), which coating also contains VULCAN 72R™ carbon black, reference U.S. Pat. No. 4,517,268, the disclosures of which are totally incorporated herein by reference; and the like. Polymer coatings not in close proximity in the triboelectric series can also be selected, reference U.S. Pat. Nos. 4,937,166 and 4,935,326 the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected. Carrier particles that may be selected for the developers of the present invention are illustrated in U.S. Pat. No. 4,517,268, the disclosure of which is totally incorporated herein by reference.

Furthermore, the diameter of the carrier particles, preferably spherical in shape, is generally from about 50 microns to about 1,000, and preferably from about 60 to about 100, and more preferably about 100 microns thereby permitting them to possess sufficient density and inertia to avoid adherence to the electrostatic images during the development process. The carrier component can be mixed with the toner composition in various suitable combinations, such as from about 1 to 5 parts per toner to about 50 parts to about 100 parts by weight of carrier.

The toner compositions of the present invention can be prepared by a number of known methods, including mechanical blending and melt blending the toner resin particles, pigment particles or colorants, wax, optional toner additives, followed by mechanical attrition including classification. The toner particles are usually pulverized and classified, thereby providing a toner with an average volume particle diameter of from about 7 to about 25, and preferably from about 9 to about 15 microns as determined by a Coulter Counter. The toner compositions of the present invention are particularly suitable for preparation in a compounding extruder such as a corotating intermeshing twin screw extruder of the type supplied by the Werner & Pfleiderer Company of Ramsey, N.J. Subsequently, the toner surface additive mixture is included on the toner by, for example, the mixing of the toner and surface additives.

The toner surface additives are present in effective amounts of, for example, from about 0.1 to about 5 weight percent. Examples of additives include mixtures of metal salts of fatty acids like zinc stearate, magnesium stearate, fumed silica particles, and metal oxides like titanium dioxide, and fluoropolymer particles such as KYNAR®. Especially preferred in embodiments is 0.4 weight percent of zinc stearate, 0.6 weight percent of AEROSIL TS530® obtained from Cabot Corporation, and 0.6 to 0.8 weight percent of titanium dioxide P25®$TiO_2$ obtained from Degussa Chemicals. In embodiments, the metal salt, such as zinc stearate, is present in an amount of from about 0.2 to about 1 and preferably 0.3 to 0.4; the silica is present in an amount of from about 0.2 to about 0.8 and preferably 0.6; and the metal oxide like titanium oxide ($TiO_2$) P25® is present in an amount of from about 0.4 to about 1.5 and preferably 0.6 weight percent. In embodiments is 0.4 weight percent of zinc stearate, 0.6 weight percent of AEROSIL TS530® obtained from Cabot Corporation, and 0.6 to 0.8 weight percent of titanium dioxide P25® $TiO_2$ obtained from Degussa Chemicals. In embodiments, the metal salt, such as zinc stearate, is present in an amount of from about 0.2 to about 1 and preferably 0.3 to 0.4; the silica is present in an amount of from about 0.2 to about 0.8 and preferably 0.6; and the metal oxide like titanium oxide ($TiO_2$) P25® is present in an amount of from about 0.4 to about 1.5 and preferably 0.6 weight percent.

The toner and developer compositions of the present invention may be selected for use in developing images in insulative electrostatographic imaging systems containing therein, for example, conventional photoreceptors, such as selenium and selenium alloys. Also useful, especially wherein there is selected negatively charged toner compositions for discharged-area development, are layered photoresponsive imaging members comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, titanyl phthalocyanines, and vanadyl phthalocyanines, while examples of charge transport layers include the aryl amines as disclosed in U.S. Pat. No. 4,265,990, the disclosure of which is totally incorporated herein by reference. Moreover, there can be selected as photoconductors hydrogenated amorphous silicon, and as photogenerating pigments squaraines, perylenes, and the like.

The following Examples are provided, wherein parts and percentages are by weight unless otherwise indicated.

EXAMPLE I

A crosslinked unsaturated polyester resin can be prepared by the reactive extrusion process by melt mixing 99.3 parts of a linear unsaturated polyester with the following structure

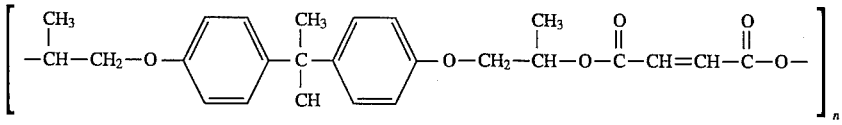

wherein n is the number of repeating units and having $M_n$ of about 4,000, $M_w$ of about 10,300, $M_w/M_n$ of about 2.58 as measured by GPC, onset $T_g$ of about 55° C. as measured by DSC, and melt viscosity of about 29,000 poise at 100° C. and about 750 poise at 130° C. as measured at 10 radians per second, and 0.7 parts benzoyl peroxide initiator as outlined in the following procedure.

The unsaturated polyester resin and benzoyl peroxide initiator are blended in a rotary tumble blender for 30 minutes. The resulting dry mixture is then fed into a Werner & Pfleiderer ZSK-30 twin screw extruder, with a screw diameter of 30.7 millimeters and a length-to-diameter (L/D) ratio of 37.2, at 10 pounds per hour using a loss-in-weight feeder. The crosslinking is carried out in the extruder using the following process conditions: barrel temperature profile of 70/140/140/140/140/140/140° C., die head temperature of 140° C., screw speed of 100 revolutions per minute, and average residence time of about three minutes. The extrudate melt, upon exiting from the strand die, is cooled in a water bath and pelletized. The product, which is crosslinked polyester, has an onset $T_g$ of about 54° C. as measured by DSC, melt viscosity of about 40,000 poise at 100° C. and about 150 poise at 160° C. as measured at 10 radians per second, a gel content of about 29 weight percent, and a mean microgel particle size of about 0.1 micron as determined by transmission electron microscopy.

The linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 3,900, $M_w$ of about 10,100, $M_w/M_n$ of about 2.59, and onset $T_g$ of 55° C. which is substantially the same as the original noncrosslinked resin, which indicates that it contains no sol.

EXAMPLE II

A crosslinked unsaturated polyester resin is prepared by the reactive extrusion process by melt mixing 98.6 parts of a linear unsaturated polyester with the structure and properties described in Example [, and 1.4 parts of benzoyl peroxide initiator as outlined in the following procedure.

The unsaturated polyester resin and benzoyl peroxide initiator are blended in a rotary tumble blender for 30 minutes. The resulting dry mixture is then fed into a Werner & Pfleiderer ZSK-30 twin screw extruder at 10 pounds per hour using a loss-in-weight feeder. The crosslinking is carried out in the extruder using the following process conditions: barrel temperature profile of 70/160/160/160/160/160/160° C., die head temperature of 160° C., screw rotational speed of 100 revolutions per minute and average residence time of about three minutes. The extrudate melt, upon exiting from the strand die, is cooled in a water bath and pelletized. The product which is crosslinked polyester has an onset $T_g$ of about 54° C. as measured by DSC, melt viscosity of about 65,000 poise at 100° C. and about 12,000 poise at 160° C. as measured at 10 radians per second, a gel content of about 50 weight percent and a mean microgel particle size of about 0.1 micron as determined by transmission electron microscopy.

The linear and crosslinked portions of the product are separated by dissolving the product in tetrahydrofuran and filtering off the microgel. The dissolved part is reclaimed by evaporating the tetrahydrofuran. This linear part of the resin, when characterized by GPC, is found to have $M_n$ of about 3,900, $M_w$ of about 10,100, $M_w/M_n$ of about 2.59, and onset $T_g$ of 55° C., which is substantially the same as the original noncrosslinked resin, which indicates that it contains no sol.

EXAMPLE III

A toner was prepared by admixing in an extruder at about 125° C. 87 weight percent of the crosslinked polyester of Example I: and with a gel content of 29, 4 weight percent of 660P polypropylene wax obtained from Sanyo Chemicals of Japan, 4 weight percent of the compatibilizer AX8840, and 5 weight percent of REGAL 330® carbon black. Subsequently, the toner was classified to enable toner particles with an average particle volume diameter of 9 microns as determined by a Coulter Counter. Thereafter, there was added to the toner by mixing in a jar mill with ⅛ inch diameter steel balls a mixture of surface additives of 0.3 weight percent of zinc stearate, 0.6 weight percent of fumed colloidal silica TS530® obtained from Cabot Corporation and 0.6 weight percent of titanium oxide P25® $TiO_2$ obtained from Degussa Chemicals.

About three parts of the above prepared toner and 100 parts of carrier were admixed to provide a developer. The carrier particles were comprised of a ferrite core, solution coated with 0.6 weight percent of a polymer coating consisting of 20 weight percent of VULCAN 72R® carbon black, available from Cabot Corporation, and 80 percent by weight of a terpolymer of methylmethacrylate, styrene and triethoxysilane (85/15/5).

The toner triboelectric charge was a negative −16.4 microcoulombs per gram at a toner concentration of 2.89 weight percent as determined by the known Faraday Cage method. The developer breakdown potential in volts was greater than 1,000 volts, and the developer conductivity measured at 400 volts per millimeter was $1.0\times10^{-13}$ (ohm-cm)$^{-1}$, as measured in a conductivity cell, reference U.S. Pat. No. 5,196,803, the disclosure of which is totally incorporated herein by reference. The detoned carrier breakdown potential was 422 volts, and the detoned carrier conductivity measured at 400 volts per millimeter was $1.40\times10^{-9}$ (ohm-cm)$^{-1}$.

For an imaging evaluation, a Xerox Corporation 1025 type copier was used with a selenium alloy drum photoconductor, and a single magnetic roll development housing. The fuser set temperature was 194° C., the fuser roll was a hard aluminum roll coated with TEFLON® fluoropolymer, the fuser pressure roll was a hard aluminum roll coated with silicone rubber, and the fusing/pressure rollers were operated in a dry manner, that is without any application of release agent such as silicone oil or the like. Excellent xerographic prints free of background or other staining were obtained with the aforementioned toner, and dark black images of optical density 1.31 were developed from target input images having a nominal 1.0 optical density. The fuser roll surface remained free of toner, even though the fuser roll surface was operated without any external application of release agent.

EXAMPLE IV

The toner blended with the three surface additives of Example III was mixed with a coated carrier to form a developer. The carrier particles were comprised of a ferrite core, coated with a terpolymer of methylmethacrylate, styrene and triethoxysilane.

For this developer mixture, the toner charge was a negative −32.2 microcoulombs per gram at a toner concentration of 2.94 weight percent. The developer breakdown potential in volts was greater than 1,000 volts, and the developer conductivity measured at 400 volts per millimeter was highly insulative at $10^{-16}$ (ohm-cm)$^{-1}$. The detoned carrier breakdown potential was greater than 1,000 volts, and the detoned carrier conductivity measured at 400 volts per millimeter was $10^{-16}$ (ohm-cm)$^{-1}$.

The developer was evaluated for imaging performance as described in Example III, and an output image density of 1.12 optical density was achieved. In this test, the fuser roll surface remained free of toner, even though the fuser roll surface was operated without any external application of release agent.

EXAMPLE V

The toner blended with the three surface additives detailed in Example III was mixed with a coated carrier to form a developer. The carrier particles were comprised of a 98 micron Hoeganese unoxidized steel grit core, solution coated with 1.06 weight percent of an 80/20 (80 weight percent, and 20 weight percent) lacquer of polymethylmethacrylate/VULCAN 72R® carbon black.

The toner triboelectric charge was a negative −18.9 microcoulombs per gram at a toner concentration of 2.84 weight percent. The developer breakdown potential in volts was 45 volts, and the developer conductivity measured at 40 volts per millimeter was $2.2\times10^{-7}$ (ohm-cm)$^{-1}$. The detoned carrier breakdown potential was 24 volts, and the detoned carrier conductivity measured at 40 volts per millimeter was $1.3\times10^{-5}$ (ohm-cm)$^{-1}$.

The developer was evaluated for imaging performance in a Xerox 1025 copier as described in Example III, and the resulting copies were totally black in both image and nonimage background areas. This xerographic imaging failure indicated that the developer, as a result of its low value of breakdown potential, was acting as a highly conductive short circuit between the development housing and nearby grounded metal parts of the xerographic machine. The development bias in the Xerox 1025 copier is normally set at 300 volts, a value which greatly exceeds the 45 breakdown voltage of the test developer. As a result, the development bias leaks through the developer brush, and this loss of bias produces the excessive image development observed even in nonimage background areas of the test copies.

This Example illustrates that the toner from Example III should preferably be coupled with a high breakdown potential carrier.

COMPARATIVE EXAMPLE VI

A toner was prepared by admixing in an extruder at about 125° C. 94 weight percent of the crosslinked polyester of Example I and with a gel content of 29, and 6 weight percent of REGAL 330® carbon black. Subsequently, the toner was classified to enable toner particles with an average particle volume diameter of 9 microns as determined by a Coulter Counter. Thereafter, there was added to the toner by mixing in a jar mill with ⅛ inch diameter steel balls a mixture of surface additives of 0.4 weight percent of zinc stearate, and 0.4 weight percent of fumed colloidal silica TS530® obtained from Cabot Corporation.

About three parts of the above prepared toner and 100 parts of carrier described in Example III were admixed to provide a developer, and for the resulting developer the toner triboelectric charge was measured to be a negative −9.3 microcoulombs per gram at a toner concentration of 2.94 weight percent.

The developer was evaluated for imaging performance in a Xerox Corporation 1025 copier as described in Example III, and an output image density of 1.33 optical density was achieved. However, in this test the fuser roll surface immediately became contaminated with toner which offset from the xerographic image onto the output paper copies, and such offset toner created undesirable contamination of both the front and back surfaces of the paper copies. During continuous copying operation, the fused copies contained multiple overlapping images created by continual transfer of offset images from the fuser and pressure rollers to the copies, and the copies were thus effectively not legible.

This comparative test indicates that internal wax, reference the toner of Example III, is an important component for offset-free fusing performance with oil-free fusers.

The base waxy toner described in Example III can be blended with a mixture of surface additives of 0.3 weight percent of KYNAR 201 F® obtained from Atochem, and 0.7 weight percent of AEROSIL R972® obtained from Degussa. This toner can then be blended with the carrier of Example III. The toner triboelectric charge is a negative −19.2 microcoulombs per gram at a toner concentration of 5.8 weight percent. This developer can be evaluated for imaging performance as described in Example III, and an output image density of 1.36 optical density is achievable. Also, the fuser roll surface remained free of toner, even though the fuser roll surface was operated without any external application of release agent.

Other modifications of the present invention may occur to those skilled in the art subsequent to a review of the present application. The aforementioned modifications, including equivalents thereof, are intended to be included within the scope of the present invention.

What is claimed is:

1. An insulative developer composition consisting essentially of resin particles, pigment particles, low molecular weight with a weight average molecular weight of from about 1,000 to about 20,000, wax component particles, compatibilizer, and a surface additive mixture comprised of from about 0.1 to about 0.8 weight percent in each instance of metal salts of fatty acids, silica particles and metal oxide particles; and carrier particles comprised of a ferrite core with a polymer coating or mixture of polymer coatings; and wherein said coating or coatings contains a conductive component, and wherein said developer is of a conductivity of from about $10^{-14}$ to about $10^{-16}$ (ohm-cm)$^{-1}$.

2. A developer in accordance with claim 1 wherein said metal salt is zinc stearate present in an amount of from about 0.3 to about 0.4 weight percent, said silica is present in an amount of from about 0.2 to about 0.8 percent, and said metal oxide is titanium oxide present in an amount of from about 0.4 to about 1.5 percent.

3. A developer in accordance with claim 1 wherein the pigment particles are carbon black.

4. A developer in accordance with claim 1 wherein the weight average molecular weight of the wax is from about 1,000 to about 10,000.

5. A developer in accordance with claim 1 wherein the weight average molecular weight of the wax is from about 1,000 to about 3,000.

6. A developer in accordance with claim 1 wherein the wax is polypropylene, or polyethylene.

7. A developer in accordance with claim 1 wherein the wax is present in an amount of from about 3 to about 7 weight percent.

8. A developer in accordance with claim 1 wherein the surface additive mixture contains from about 0.2 to about 0.4 of each component.

9. A developer in accordance with claim 1 wherein the surface additive mixture contains about 0.4 of each component.

10. A developer in accordance with claim 1 wherein the surface additive mixture contains as a metal salt zinc stearate and as a metal oxide titanium dioxide, and wherein the silica particles are fumed silicas.

11. A developer in accordance with claim 1 wherein the resin particles are comprised of crosslinked polyesters.

12. A developer composition in accordance with claim 11 wherein the polyester resin particles have a gel content of from about 20 to about 40 percent, and the conductive component is carbon black.

13. A developer composition in accordance with claim 11 wherein the polyester resin particles have a gel content of from about 25 to about 35 percent.

14. A developer composition in accordance with claim 11 wherein the polyester resin particles have a gel content of about 29 percent.

15. A developer composition in accordance with claim 11 wherein the polyester results from the condensation reaction of dimethylterephthalate, 1,2-propanediol, 1,3-butanediol, and pentaerythritol; or wherein the polyester results from the condensation reaction of dimethylterephthalate, 1,2-propanediol, diethylene glycol, and pentaerythritol.

16. A developer in accordance with claim 1 with a breakdown voltage of from about 300 to about 1,000 volts.

17. A developer in accordance with claim 1 wherein the carrier coating is a fluorocarbon.

18. A developer in accordance with claim 1 wherein the carrier coating is the fluorocarbon polyvinylidene fluoride.

19. A developer in accordance with claim 1 wherein the carrier coating is comprised of a mixture of two polymers not in close proximity in the triboelectric series.

20. A developer in accordance with claim 19 wherein the mixture of two polymers is comprised of polymethylmethacrylate and polyvinylidene fluoride.

21. A developer in accordance with claim 19 wherein the mixture of two polymers is comprised of polymethylmethacrylate, from about 40 to about 60 weight percent, and polyvinylidene fluoride, from about 60 to about 40 weight percent.

22. A developer in accordance with claim 16 wherein the carrier coating is comprised of a copolymer of vinylchloride and trichlorofluoroethylene.

23. A developer in accordance with claim 1 wherein the ferrite is a zinc, copper, magnesium ferrite.

24. A developer in accordance with claim 1 wherein the carrier coating weight is from about 0.1 to about 1.25 weight percent.

25. A developer composition in accordance with claim 19 wherein the carrier coatings are comprised of a mixture of polymethylmethacrylate and vinyl chloride/trifluorochloroethylene.

26. A developer in accordance with claim 2 wherein said silica is present in an amount of 0.6 weight percent, and said titanium dioxide is present in an amount of 0.6 weight percent.

27. A developer composition in accordance with claim 1 wherein the toner composition possesses a negative triboelectric charge of from about 15 to about 30 microcoulombs per gram.

28. A developer in accordance with claim 1 with a breakdown voltage of from about 300 to about 1,000 volts.

29. A developer in accordance with claim 1 with a breakdown voltage, $V_B$, of at least 300 volts.

30. A developer in accordance with claim 1 wherein said resin particles are selected from the group consisting of styrene acrylates, styrene methacrylates, and styrene butadienes.

31. A method for obtaining images in an insulative magnetic brush imaging apparatus which comprises generating an electrostatic latent image on a layered photoconductive imaging member, subsequently affecting development of this image with the toner composition of claim 1, thereafter transferring the image to a permanent substrate, and optionally permanently affixing the image thereto.

32. A developer in accordance with claim 1 wherein the compatibilizer is comprised of the reaction product of the hydroxyl end groups or acid end groups contained on said resin particles with an ethylene-glycidyl methacrylate copolymer.

33. A developer in accordance with claim 32 wherein the resin particles are comprised of a polyester.

34. A developer in accordance with claim 1 wherein the compatibilizer is a grafted ethylene-glycidyl methacrylate copolymer comprised of the reaction product of an ethylene-glycidyl methacrylate copolymer with said resins containing thereon acid, or hydroxyl end groups.

35. A developer in accordance with claim 1 wherein the metal salt is zinc stearate present in an amount of from about 0.2 to about 1 weight percent, the silica particles are present in an amount of from about 0.2 to about 0.8 weight percent, and the metal oxide is titanium oxide present in an amount of from about 0.4 to about 1.5 weight percent.

36. A developer in accordance with claim 1 wherein the fatty acid salt is present in an amount of from about 0.1 to about 1 and preferably from about 0.3 to about 0.4 weight percent, the silica particles and the metal oxide surface additives are present in an amount of from about 0.3 to about 1 and preferably about 0.6 weight percent.

* * * * *